United States Patent [19]

Yano et al.

[11] 3,958,151

[45] May 18, 1976

[54] METHOD AND APPARATUS FOR DRIVING A PLASMA DISPLAY PANEL WITH APPLICATION OF OPPOSITE PHASE SUPPRESSION PULSES TO SELECTION ELECTRODES

[75] Inventors: Akira Yano; Norio Sato; Tunekiyo Iwakawa, all of Tokyo, Japan

[73] Assignee: Nippon Electric Company Limited, Tokyo, Japan

[22] Filed: Oct. 17, 1973

[21] Appl. No.: 407,284

[30] Foreign Application Priority Data

Oct. 18, 1972 Japan ..... 47-104245

[52] U.S. Cl. ..... 315/169 TV; 315/169 R

[51] Int. Cl.² ..... H05B 37/00

[58] Field of Search ..... 315/169 R, 169 TV; 340/324 M

[56] References Cited

UNITED STATES PATENTS

| | | | |
|---|---|---|---|
| 3,432,724 | 3/1969 | Frost | 315/169 R |
| 3,522,473 | 8/1970 | Babb | 315/169 R |
| 3,719,940 | 3/1973 | Lay | 315/169 TV X |

*Primary Examiner*—R. V. Rolinec
*Assistant Examiner*—Lawrence J. Dahl
*Attorney, Agent, or Firm*—Hopgood, Calimafde, Kalil, Blaustein & Lieberman

[57] ABSTRACT

When a plasma display panel driven by a conventional driving circuit therefor, spurious pulsed voltages appear across discharge cells which are in the vicinity of a selected discharge cell. A method and apparatus for driving a plasma display panel in a time division manner includes supplying the plasma display panel electrodes with suppress pulse trains for cancelling the spurious pulse voltages coupled thereto. The suppress pulse trains are in synchronism with, and of a polarity opposite to the driving pulses that are supplied to such electrodes in accordance with time division principles.

3 Claims, 14 Drawing Figures

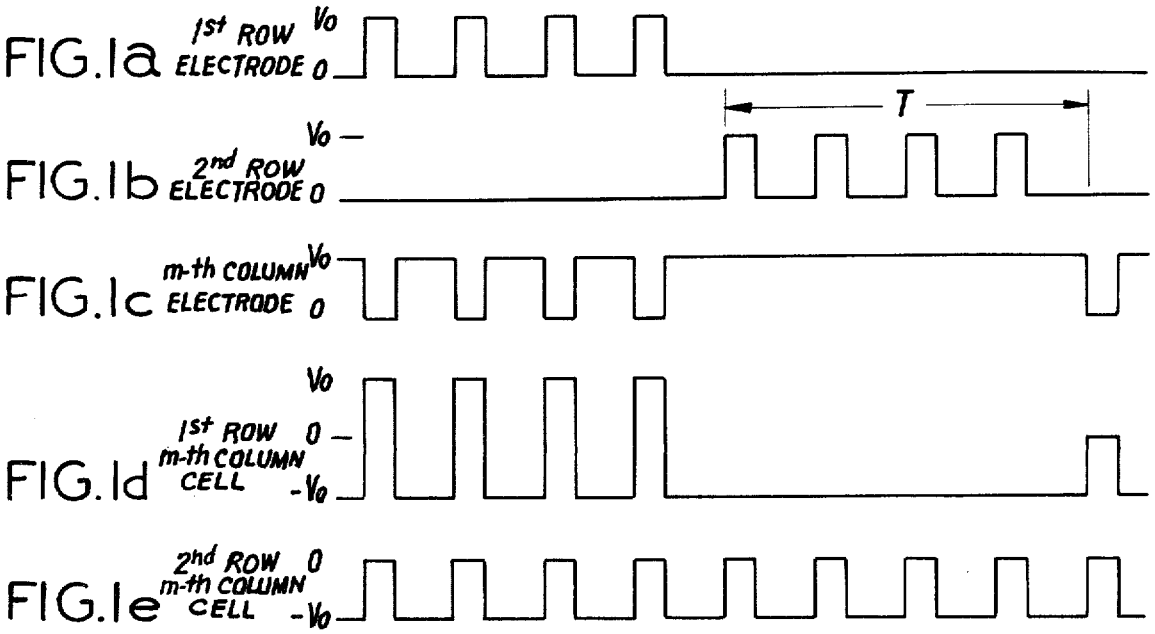
FIG.1a
1st ROW ELECTRODE
Vo
0
T
FIG.1b
2nd ROW ELECTRODE
Vo
0
FIG.1c
m-th COLUMN ELECTRODE
Vo
0
FIG.1d
1st ROW m-th COLUMN CELL
Vo
0
-Vo
FIG.1e
2nd ROW m-th COLUMN CELL
0
-Vo
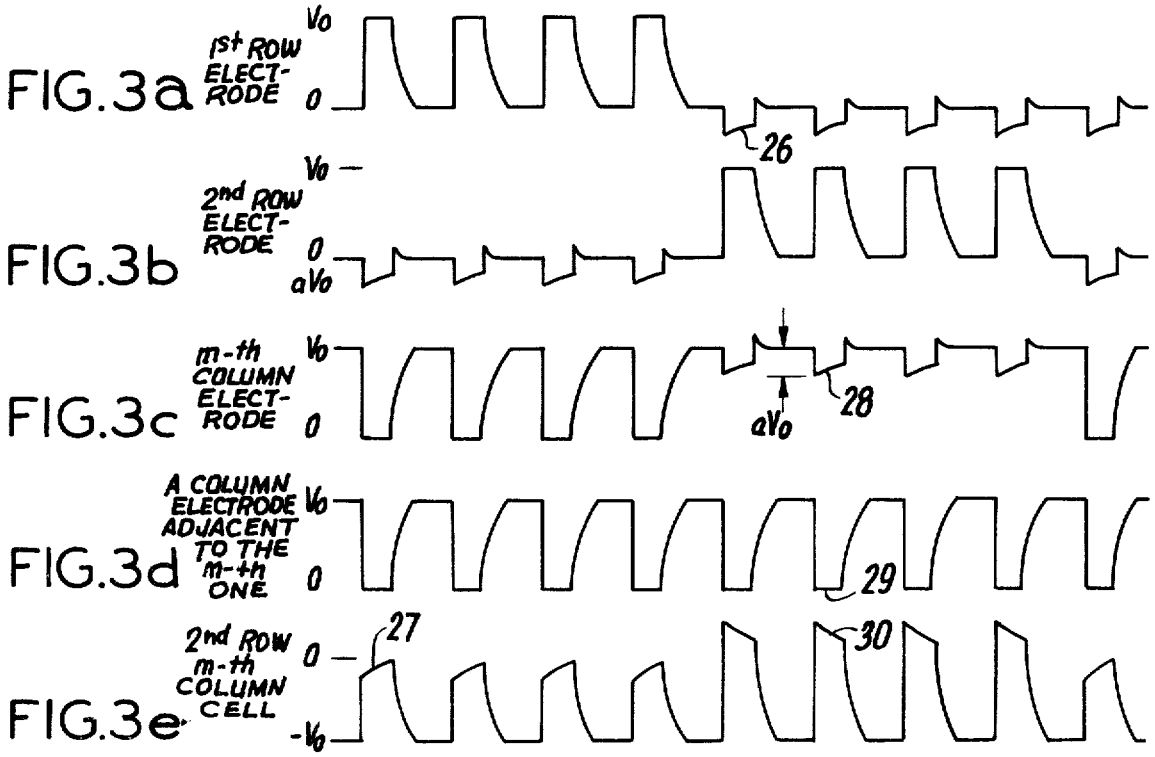
FIG.3a
1st ROW ELECTRODE
Vo
0
26
FIG.3b
2nd ROW ELECTRODE
Vo
0
aVo
FIG.3c
m-th COLUMN ELECTRODE
Vo
0
aVo
28
FIG.3d
A COLUMN ELECTRODE ADJACENT TO THE m-th ONE
Vo
0
29
FIG.3e
2nd ROW m-th COLUMN CELL
27
30
0
-Vo

METHOD AND APPARATUS FOR DRIVING A PLASMA DISPLAY PANEL WITH APPLICATION OF OPPOSITE PHASE SUPPRESSION PULSES TO SELECTION ELECTRODES

DISCLOSURE OF THE INVENTION

BACKGROUND OF THE INVENTION

This invention relates to electronic displays and, more specifically, to a method and apparatus for driving an external electrode discharge display panel or plasma display panel in a time division fashion.

External electrode discharge display panels and circuits for driving such displays are described in a prior U.S. patent application Ser. No. 388,787 filed Aug. 16, 1973 now U.S. Pat. No. 3,869,644, by Akira Yano et al. German patent application No. P 23 42 359.5 filed Aug. 21st, 1973).

As described in the prior patent application, one of the conventional driving circuits comprises means for cyclically supplying a driving pulse train of a predetermined duration to the electrodes of a first electrode group, such as the row electrodes array, of a plasma display panel, and means for selectively supplying another driving pulse train of the opposite phase or polarity to the electrodes of a second group, such as the column electrodes. An intermittent gas discharge occurs in a gas discharge cell of the plasma display panel interposed between the spatially opposing electrodes simultaneously supplied with the drive pulse trains. If the frequency of the intermittent gas discharge is sufficiently high (for example, 10 kHz), the selected cells glow forms an observable display of a numeral, a letter, a symbol, and/or a combination of these.

In one of the conventional driving circuits, use is made of drivers comprising transistors connected to the electrodes through collector resistors. When the electrodes are not selected, the associated transistors are rendered nonconductive and the electrodes are either connected to a source of a d.c. voltage $V_0$ or to ground through the corresponding collector resistors. When a certain row electrode $C_k$ is not selected while the adjacent several row electrodes are selected, the row electrode $C_k$ is supplied with a spurious voltage pulse derived by differentiation of the pulse voltages supplied to the adjacent row electrodes with a time constant RC, where R represents the resistance of the collector resistor connected to each of the row electrodes and C represents the total electrostatic capacitance comprising the electrostatic capacities between the row electrode $C_k$ and the adjacent row electrodes, and the stray capacitance between the wiring to the row electrode $C_k$ and conductors for the adjacent row electrodes. Although the driving circuit of this type is preferable because of the simplicity of its circuitry, the spurious voltage pulse often results in an undesired display.

In order to attain stable operation of the driving circuit, it is necessary to restrict the potential $V_0$ supplied by the d.c. source. That is, the driving circuit has been operable only in a limited range of the driving pulse voltage. The time constant RC may be reduced by a reduction in at least one of the resistance R and the total electrostatic capacity C. Reduction of the capacitance C may readily be achieved by enlarging the display panel. However, this is contrary to the general requirement for a compact display panel. Reduction of resistance R results in an increase in the power consumption when the transistors are turned on to provide a desired display.

Besides the driving circuit of the type described above in some detail, a driving circuit comprising drivers exhibiting a high output impedance when the associated electrodes are not selected has been deficient because of the restriction imposed on the driving pulse voltage for normal operation of the circuit due to spurious voltage pulses produced by the electrostatic coupling.

SUMMARY OF THE INVENTION

It is therefore an object of the present invention to provide a method for driving an external electrode discharge display panel with a driving circuit of simple construction, substantially avoiding any undesired display contents.

It is another object of this invention to provide a method of the type described, capable of retilizing an operating voltage of an appreciably wide range.

According to the principles of the present invention there is provided a method for driving an external electrode discharge display panel having a plurality of gas discharge cells interposed between a first and a second group of electrodes. A driving pulse train of a predetermined duration is selectively supplied to each of those electrodes of the first and second groups which are selected in a time division fashion to produce a gas discharge in the cells interposed between the selected electrodes. The improvement comprises supplying at least one of the electrodes of at least one of the first and second groups with a suppression pulse train in synchronism with the driving pulse trains, at least during the time in which said one electrode is not selected, the suppression pulse train being opposite in phase to the driving pulse train that is supplied to said one electrode when said one electrode is selected.

BRIEF DESCRIPTION OF THE DRAWINGS

FIGS. 1*a*-1*e* depict wave forms of driving pulse trains supplied to electrodes of a plasma display panel operated in a time division manner;

FIGS. 3*a*-3*e* show typical wave forms of the electrode potential observed with a plasma display panel driven by the conventional driving circuit illustrated in FIG. 2;

DESCRIPTION OF THE PREFERRED EMBODIMENTS:

For convenience of description, it is assumed in the following discussion that a plasma display panel comprises a plurality of row electrodes, *n* in number, and a plurality of column electrodes.

Figure 2:
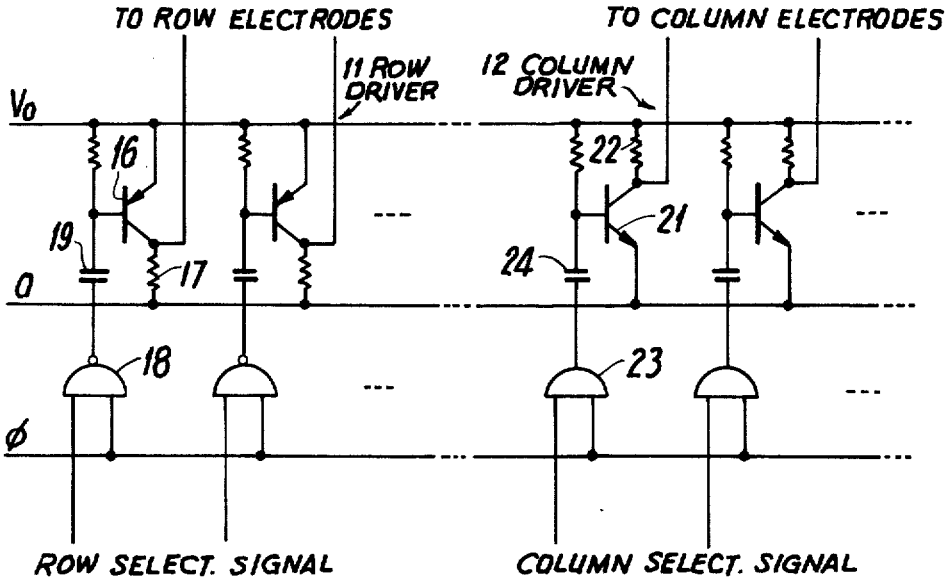
FIG. 2 is a schematic circuit diagram of a conventional circuit for driving a plasma display panel.

Before describing several preferred embodiments of the present invention, operation of a conventional driving circuit for a plasma display panel will be analysed with reference to FIGS. 1 through 3 in order to facilitate an understanding of the principles of operation of a method and apparatus according to the present invention.

Referring specifically to FIG. 1 which is a substantial reproduction of FIG. 1 of the prior patent application referred to hereinabove, a conventional driving circuit comprises structures (not shown) for cyclically supplying driving pulse voltages to the first, the second, . . . , and the n-th row electrodes (not shown). The pulse voltages comprise pulse trains of a common duration T shifted by a common interval T as exemplified at 1*a* and 1*b* for the first and the second row electrodes. The pulses of each pulse train have a pulse height substantially equal to a d.c. source voltage $V_0$. The pulse trains are refreshed at a period nT.

The driving circuit further comprises structures (not shown) for selectively supplying a similar driving pulse voltage to each of the column electrodes (not shown) crossing the row electrodes at those gas discharge cells wherein production of the intermittent display discharge is desired. As shown in FIG. 1 at *c* for the m-th electrode, the voltage pulses supplied to a column electrode are of a phase or polarity opposite to the pulses supplied to the row electrodes, and appear in timed relation to the latter pulses. Let it be assumed for convenience of description only that the pulses supplied to the column electrodes also have a pulse height $V_0$. With the illustrated pulses supplied to the row and column electrodes, an alternating voltage is supplied across the first row m-th column cell as illustrated in FIG. 1*d*. That cell therefore glows during the period T. The second row, m-th column cell is supplied with the voltage depicted in FIG. 1 at *e*, and is made to glow for a very short transient time only by the first pulse applied thereacross.

For the time division drive of a plasma display panel, it is necessary to choose the d.c. source voltage $V_0$ in such a manner that a cell glows only when a pair of electrodes disposed on both sides of the cell are selected, and that a cell not glow when only one of the electrode pair is selected. Let is be assumed that all the cells are selected and that the source voltage is raised. The voltage at which all the cells begin to glow is represented by $V_f$. Let the source voltage now be reduced. The voltage at which the glow of all cells disapprears is designated by $V_s$. in order that an optionally selected cell should glow, the relation $$V_0 \geqq V_f$$

must be satisfied. In order that a cell should not glow when only one of the electrode pair is selected, $$V_0 < 2V_s$$

must hold. The range of the source voltage in which the driving circuit is operable is therefore $$V_f \leqq V_0 < 2V_s.$$

Referring now to FIG. 2, a driving circuit for a plasma display panel comprises a row driver 11 and a column driver 12. The row driver 11 comprises an array of row electrode driven stages, each including a switching PNP transistor 16 having its collector electrode directly connected to an associated one of the row electrodes and to ground through a collector resistor 17. The emitter electrode is connected to a source (not shown) of a d.c. voltage of amplitude $V_0$. The row driver 11 further comprises a NAND gate 18 for controlling each PNP transistor 16 through a level shifting capacitor 19 by coincidence of a clock pulse train $\phi$ with a row selection signal cyclically appearing for each row electrode.

The column driver 12 similarly comprises a plural stage array each including a switching NPN transistor 21 whose collector electrode is directly connected to an associated column electrode and to the d.c. voltage source through a collector resistor 22. The emitter electrode is grounded. The column driver 12 further comprises an AND gate 23 for controlling each NPN transistor 21 through a level shifting capacitor 24 by coincidence between the clock pulse train $\phi$and a column selection signal for the column electrode to be selected. It will readily be seen that the driving circuit produces the pulse trains shown in FIG. 1.

Referring to FIG. 3, electrode potentials supplied by the driving circuit illustrated with reference to FIG. 2 vary in the manner illustrated at *a*, *b*, *c*, and *d* for the first and second row electrodes and the m-th and an adjacent column electrode, and have voltage spikes, such as that designated by the numeral 26, resulting from the electrostatic coupling between the plasma display panel electrodes. Since the row electrodes are selected in a time division fashion and only one row electrode is supplied with a driving pulse train at a time, the voltage spikes resulting from the coupling between the row electrodes are small. Most of the spikes shown in FIGS. 3 *a* and *b* have therefore resulted from the coupling between the row electrodes and column electrodes. In any event, the spikes in the row electrode potentials tend to reduce the voltage applied across a cell as shown at 27 in FIG. 3 *e* for the second row, m-th column cell and do not result in an undesired display.

On the other hand, however, a plurality of column electrodes are usually simultaneously supplied with driving pulse trains. The column electrode potentials are therefore seriously affected by the coupling between column electrodes. By way of example, a spike 28 appearing in the m-th column electrode potential is derived from the driving pulses, such as 29, supplied simultaneously to the adjacent column electrodes. The pulse amplitude decreases along a discharge curve given by the time constant RC where R represents the resistance of the collector resistor, such as the resistor 22, associated with the m-th column electrode and C represents the total electrostatic capacity comprising the electrostatic capacitance between the m-th column electrode and the adjacent electrodes and the stray capacity of the wiring to the m-th column electrode. The wave form of the spike 28 is given by superposition of derivatives of the simultaneously supplied electrode potentials, such as the pulse 29.

The amplitude of the spike 28 is approximately proportional to the source voltage $V_0$ and becomes the greatest when all other column electrodes are simultaneously selected. The largest magnitude will now be represented by $aV_0$, where *a* is a constant between zero and unity. The voltage applied across a cell may thus become greater than $V_0$ as exemplified for pulse 30 [FIG. 3e] even though the cell is not selected. In order that the cell may not glow, the source voltage $V_0$ constraint is now be given by $$V_0 + aV_0 < 2V_s.$$

or $$V_o < 2V_s/(1 + a),$$

from which it is understood that the upper limit of the source voltage range is in effect reduced to $1/(1 + a)$.

In view of the above, a circuit for driving a plasma display panel in accordance with a method of the present invention comprises apparatus including capacitor means either added to the drive circuitry or made integral with a plasma display panel for supplying the row electrodes with suppression or cancellation pulse trains in phase with the driving pulses selectively supplied to the column electrodes and supplying the column electrodes with suppression pulse trains in phase with the driving pulses cyclically supplied to the row electrodes.

Figure 4:
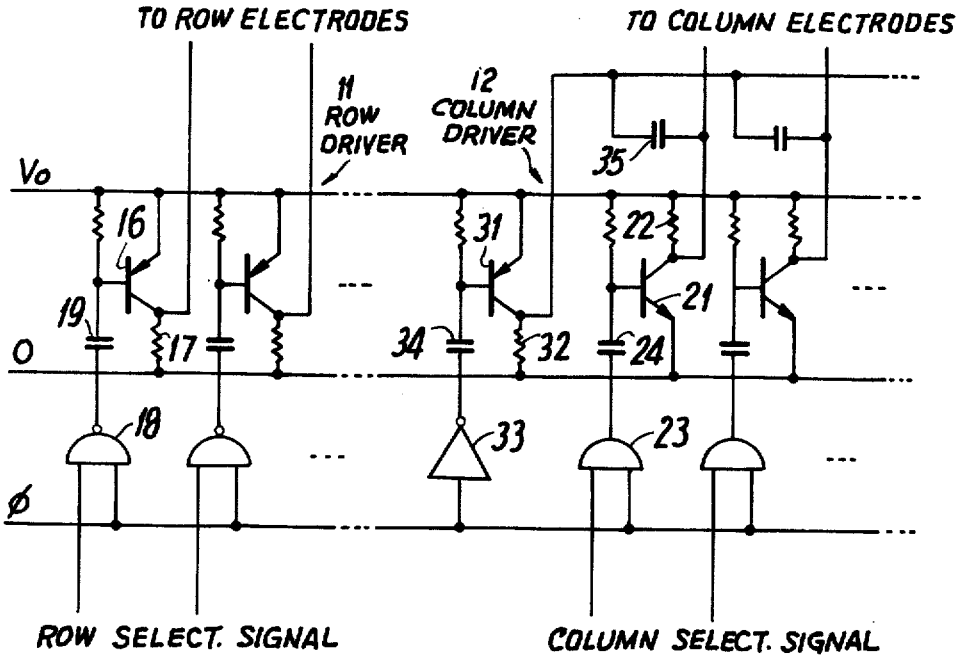
FIG. 4 is a schematic circuit diagram of a circuit for driving a plasma display panel according to the principles of the instant invention.

Referring now to FIG. 4, a circuit for driving a conventional plasma display panel in accordance with the principles of this invention is similar to that illustrated with reference to FIG. 2, except that the column driver 12 additionally comprises a single switching transistor 31 whose collector electrode is grounded through a collector resistor 32, and whose emitter electrode is connected directly to the voltage source. An inverter 33 supplies the clock pulses $\phi$ to the base electrode of the single PNP transistor 31 through a level shifting capacitor 34. The collector output signal of the single PNP transistor 31 is supplied to the column electrodes through additional capacitors, such as capacitors 35. The electrostatic capacitance of each of the additional capacitors is preferably of the order or the electrostatic capacitance between each column electrode and the remaining column electrodes.

By way of specific example, a driving circuit illustrated with reference to FIG. 2 and in which the resistance of each of the collector resistors, such as resistors 22, associated with the column electrodes was 50 kilohms could drive a plasma display panel when the $V_f$ and and $V_s$ levels were 140 V and 110 V, respectively, in a source voltage range between 140 V and 160 V. This showed that the constant $a$ above discussed was 0.38, which was an appreciably large value and that the voltage source should be substantially stable because the permissable variation allowance for the source voltage $V_o$ was only 20 V. With a driving circuit illustrated with reference to FIG. 4 and in which the electrostatic capacitance of each additional capacitor, 35 was 20 pF, it was possible to drive the plasma display panel in a source voltage range between 140 V and 210 V, which was comparable with the operating range between 140 V and 220 V determined by the characteristics of the plasma display panel.

Figure 5:
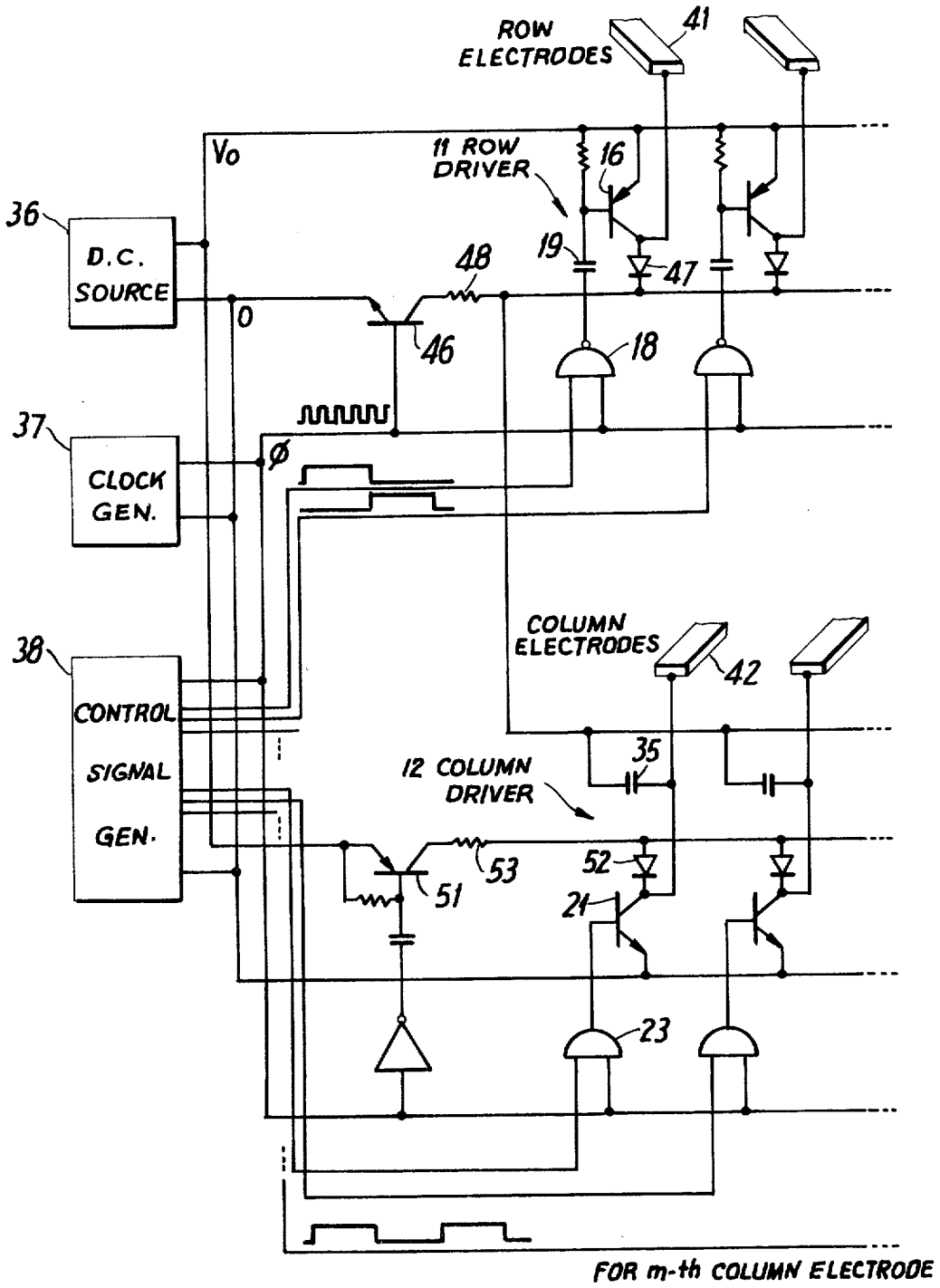
FIG. 5 is a similar diagram of another circuit for driving a plasma display panel in accordance with the principles of this invention.

Referring to FIG. 5, another driving circuit for driving a conventional plasma display panel in accordance with the principles of the present invention comprises component parts similar to those illustrated with reference to FIGS. 2 and 4, and designated with like reference numerals. For a better understanding of the circuitary for implementing the invention, a d.c. voltage source 36, a clock pulse generator 37, and a control signal generator 38 are illustrated in this figure. Also, row electrodes, such as 41, and column electrodes, such as 42, are depicted. In FIG. 5, it will be noted that the collector electrodes of the row switching PNP transistors, such as 16, are connected to a common transistor 46 of the complementary type through diodes, such as 47, disposed in a forward construction direction and a common resistor 48 of a low resistance for protecting the common transistor 46. Similarly, the collector electrodes of the column switching NPN transistors, such as 21, are connected to a common transistor 51 of the complementary type through forward directed diodes, such as 52, and a common resistor 53 of a low resistance for protecting the common transistor 51.

In operation, the on-off timing of a row switching transistor 16 differs from the on-off timing of the common transistor 46. When a row selection signal is supplied to the NAND gate 18 coupled to the switching transistor 16, the row electrode 41 is alternately connected to ground and to the voltage source 36 through a low impedance. A large current therefore can flow to the row electrode 41. The column driver 12 operates in a similar manner. The circuit is preferable in that no electric power is consumed in the collector resistors used in the circuits illustrated with reference to FIGS. 2 and 4. As before, the additional capacitors, 35 supply the column electrodes 42, with suppression pulse trains from the row driver 11. Were this not so the column electrodes which are not selected would be isolated from the circuit and consequently and be very sensitive to coupling from the adjacent electrodes each time the common transistor 51 becomes nonconductive. This is because the switching transistors coupled to such column electrodes are nonconductive when no column selection signals are supplied to the AND gates associated therewith.

Figure 6:
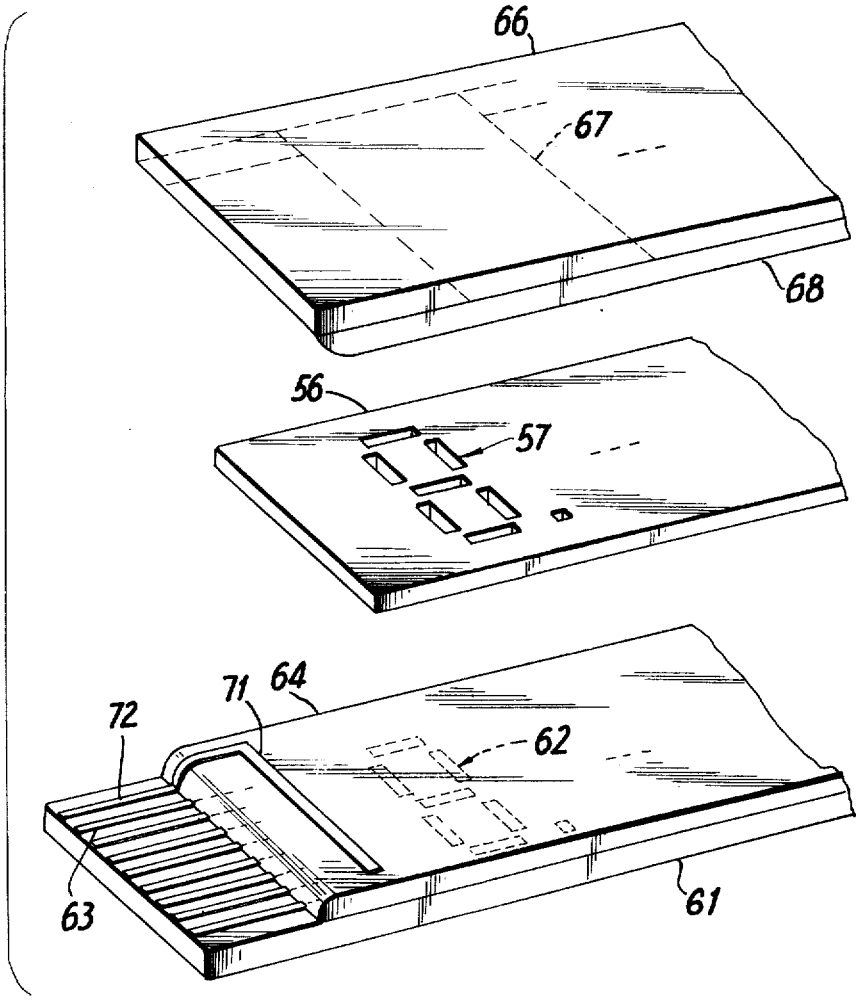
FIG. 6 is an exploded schematic partial perspective view of a plasma display panel for use in combination with the circuit illustrated in FIG. 2 for carrying out the method and principles of this invention.

Referring finally to FIG. 6, a plasma display panel for use with a driving circuit of the type illustrated with reference to FIG. 2 and for carrying out a method according to this invention comprises a center glass plate 56 through which a plurality of segment hole groups 57 are formed and a back glass plate 61 on which segment electrode groups 62 are attached in spatial correspondence with the segment holes. Lead wires 63 are arranged on the back glass plate 61 leading from the respective corresponding segment electrodes. A dielectric layer 64 is laid on the back glass plate 61 covering the segment electrode groups 62 and most parts of the lead wires 63. The panel further comprises a front glass plate 66 on which transparent electrodes 67 are attached in corrospondence with the respective segment groups 57. A transparent dielectric layer 68 is laid on the front glass plate 66 covering major portion of the transparent electrodes 67. It is to be noted that the panel still further comprises a metal ribbon 71 formed on the back glass plate dielectric layer 64 in a direction transverse to the lead wires 63 and a lead wire 72 therefor. The metal ribbon 71 forms a capacitance which cooperates with the segment electrode lead wires 63. The electrostatic capacity may be from several picofarads to several tens of picofarads. The width of the metal ribbon 71 may therefore be about 1 mm.

With respect to the above, it is observed that a plasma display panel is usually manufactured employing thick-film integrated circuit techniques and that the capacitance is readily formed. As is readily understood once a method according to this invention and a plasma display panel of this type are disclosed, the capacitor lead wire 72 should be connected to a driver for supplying a continuous source of the row driving pulse trains if the segment electrodes are selectively supplied with the column driving pulse trains described with reference to FIGS. 2, 4, and 5.

While the present invention has thus far been described in the specific context of the cases in which the coupling between the column electrodes is a source of concern, it is to be understood that this invention is equally applicable to cases where the coupling between the row electrodes is of concern. This invention is further applicable to drive a plasma display panel having electrode pairs of a type other than row and column electrodes, and segment electrodes.

What is claimed is:

1. In combination in plasma display apparatus, an electrode discharge display panel including first and second electrode groups, and a plurality of gas discharge cells disposed at the spacial intersection of the electrodes of said electrode groups, drive means for energizing said electrodes in a time division manner, said electrode energizing drive means comprising means for sequentially energizing the electrodes of said first electrode group with pulse trains of a first polarity, means for energizing said electrodes of said second group with pulse trains of a second polarity opposite to said first polarity, combinations of said electrodes in said second group being coincidentally excited in accordance with the display desired, a suppression source of pulses of said first polarity, and capacitance means coupling said suppression source to said electrodes of said second electrode group for cancelling voltages spuriously induced therein when selected of said second electrode group are energized by said second electrode group energizing means.

2. A combination as in claim 1 wherein electrodes of said second group are formed within said display panel, and wherein said capacitance means comprises conductive means secured in spaced relation to said formed electrodes in said panel.

3. A combination as in claim 1 wherein said electrode energizing means comprises switching and logic means, said capacitance means being connected thereto.

* * * * *